US010864721B2

(12) United States Patent
Martin et al.

(10) Patent No.: US 10,864,721 B2
(45) Date of Patent: Dec. 15, 2020

(54) FLUIDIC ACTUATOR SCHEDULING

(71) Applicant: HEWLETT-PACKARD DEVELOPMENT COMPANY, L.P., Spring, TX (US)

(72) Inventors: Eric Martin, Corvalis, OR (US); Andrew Koll, Corvalis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/621,308

(22) PCT Filed: Aug. 29, 2017

(86) PCT No.: PCT/US2017/049230
§ 371 (c)(1),
(2) Date: Dec. 11, 2019

(87) PCT Pub. No.: WO2019/045697
PCT Pub. Date: Mar. 7, 2019

(65) Prior Publication Data

US 2020/0114645 A1 Apr. 16, 2020

(51) Int. Cl.
*B41J 2/045* (2006.01)

(52) U.S. Cl.
CPC ..... *B41J 2/04581* (2013.01); *B41J 2/04525* (2013.01)

(58) Field of Classification Search
CPC ..... B41J 2/04581; B41J 2/04525
See application file for complete search history.

(56) References Cited

U.S. PATENT DOCUMENTS

| | | | | |
|---|---|---|---|---|
| 5,168,284 | A | 12/1992 | Yeung | |
| 6,398,332 | B1 | 6/2002 | Silverbrook et al. | |
| 6,543,879 | B1 | 4/2003 | Feinn et al. | |
| 7,524,007 | B2 | 4/2009 | Pulver et al. | |
| 7,597,435 | B2 | 10/2009 | Silverbrook | |
| 7,712,876 | B2 | 5/2010 | Silverbrook | |
| 2002/0113831 | A1 | 8/2002 | Su et al. | |
| 2012/0081430 | A1* | 4/2012 | Matsuo | B41J 2/04581 347/10 |

OTHER PUBLICATIONS

Epson's Precisioncore Printhead technology, https://assets.epson-europe.com/eu/precision-core/PrecisionCore_Fact-Sheet.pdf, Mar. 5, 2014 (7 pages).

* cited by examiner

*Primary Examiner* — Lamson D Nguyen
(74) *Attorney, Agent, or Firm* — HP Inc. Patent Department

(57) ABSTRACT

An example printer includes an actuator selection engine. The actuator selection engine is to determine, for an array including a plurality of fluidic actuators, which fluidic actuators to fire. The printer also includes a balancing engine. The balancing engine is to analyze the determined fluidic actuators to identify a large set of fluidic actuators scheduled to fire substantially simultaneously. The balancing engine is also to schedule the large set of fluidic actuators among a plurality of fire pulse groups. Each fire pulse group may include a subset of the large set of fluidic actuators to be fired at a time distinct from another subset.

15 Claims, 6 Drawing Sheets

300

400

FLUIDIC ACTUATOR SCHEDULING

BACKGROUND

A printer may form a print product (e.g., an image, a three dimensional object, etc.) on a print target (e.g., a medium, a print bed, etc.) by delivering a printing substance to the print target. The printing substance may be toner, a printing fluid (e.g., ink), or the like. For example, a fluid ejection printer may eject the printing fluid towards the print target to form the print product on the print target. The fluid ejection printer may include a plurality of fluidic actuators to cause ejection of the printing fluid towards the print target. The fluid ejection printer may also include a plurality of non-ejecting fluidic actuator, such as micro-fluidic pumps, to move fluid without ejecting it. The actuators may include a piezoelectric membrane based actuator, a thermal resistor based actuator, an electrostatic membrane actuator, a mechanical/impact driven membrane actuator, a magneto-strictive actuator, or the like.

DETAILED DESCRIPTION

Figure 1:
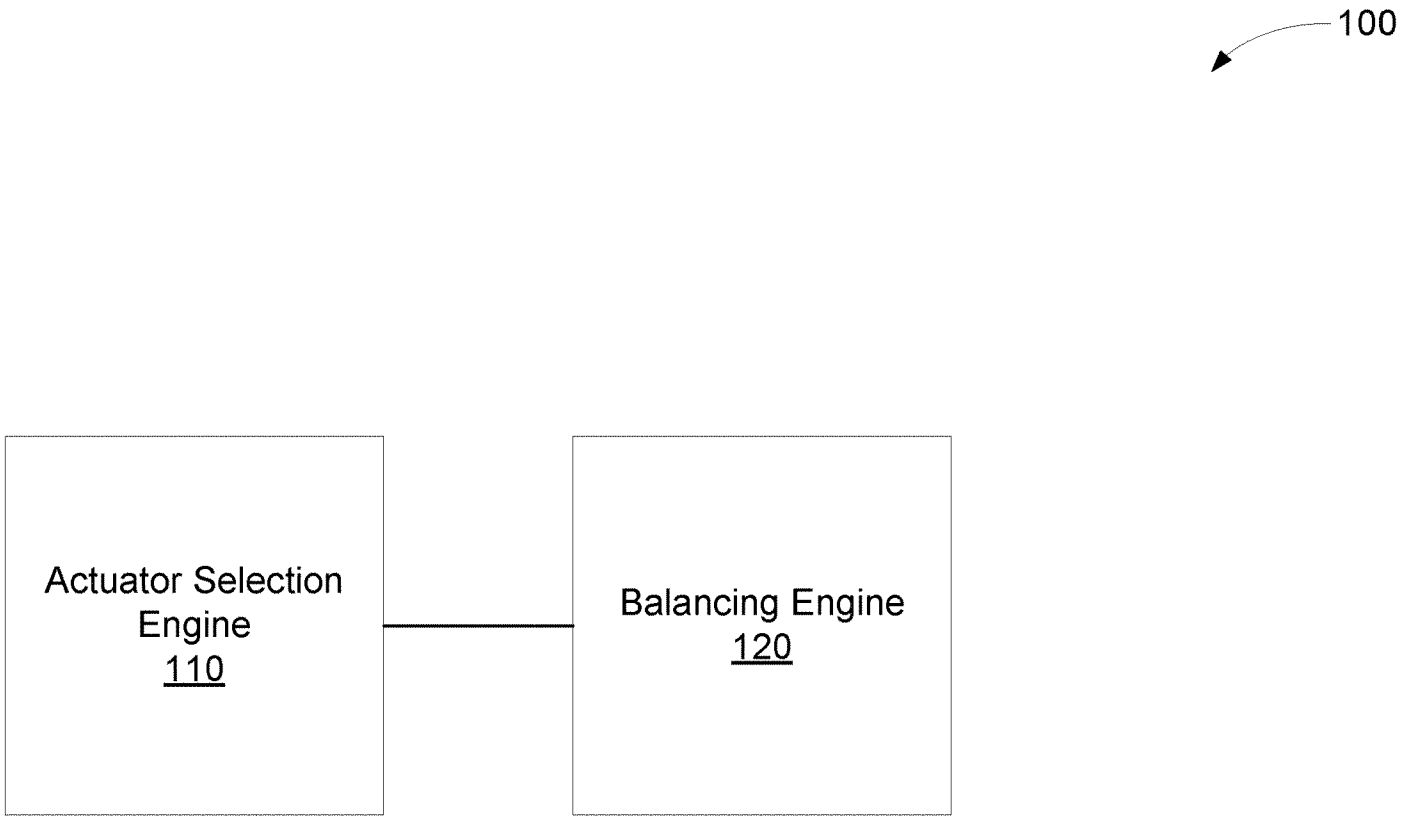
FIG. 1 is a block diagram of an example printer to schedule firing of fluidic actuators.

The fluid ejection printer may include an interface to receive a cartridge that includes a printhead. The printhead may include a plurality of nozzles arranged into arrays (e.g., columns, two dimensional arrays, or the like) on the printhead. Each nozzle may include a fluidic actuator to eject the printing fluid from the nozzle towards the print target. The printhead may also include non-ejecting actuators to move fluid without ejecting it. The fluidic actuators may be grouped into primitives. Each array, also referred to as a primitive group, may include a plurality of primitives. Each primitive may include a plurality of fluidic actuators. Each fluidic actuator in a primitive may include an address that is unique relative to other fluidic actuators in that primitive. However, fluidic actuators in different primitives may share addresses. Indeed, every primitive may have an identical address space and may use every address in the address space. In an example, there may be four, eight, ten, 12, 16, 24, 32, etc. fluidic actuators per primitive (e.g., unique addresses per primitive/array), and there may be 50, 100, 132, 150, 175, 200, 250 etc. primitives per array.

The fluid ejection printer may indicate to the printhead which fluidic actuators should be fired (e.g., which actuators should be actuated to eject fluid from the nozzles). The fluid ejection printer may indicate the fluidic actuators to be fired in an array by transmitting a fire pulse group to the printhead. The fire pulse group may include an address of the fluidic actuators to be fired. For example, the address may correspond to one fluidic actuator in every primitive in the array. The fire pulse group may also include an indication of which primitives should fire the fluidic actuator at that address or which should not. Accordingly, each primitive may read the address and the indication for that primitive to determine whether to fire the fluidic actuator in that primitive with that address. The fluid ejection printer may transmit a plurality of fire pulse groups containing different addresses to the printhead. The fluid ejection printer may transmit a print array group that includes a fire pulse group for every address in the address space for the primitives. The fluidic actuators indicated by a fire pulse group may be fired substantially simultaneously, for example, after receipt of the fire pulse group. As used herein, the term "substantially" refers to values within a particular threshold, such as 0.1%, 1%, 2%, 5%, 10%, etc. For example, fluidic actuators may fire substantially simultaneously after a fire pulse group is received, and the fire time relative to a triggering event or the fire time relative to beginning receipt of the fire pulse group may be within the particular threshold.

The printhead may have a maximum fluidic frequency or a corresponding minimum fluidic period. The term "minimum fluidic period" refers to a shortest time period between when a fluidic actuator fires and when it is able to fire again. For example, ejected fluid may leave a firing chamber, which may take time to refill. The minimum fluidic period may include the time to refill the chamber, the time for the fluid to settle, buffer time to compensate for variations among actuators or printheads, or the like. The communication links between the printer and the printhead may have a maximum communication frequency, so there may be a minimum period for a fire pulse group based on the amount of data in the fire pulse group and the maximum communication frequency. The term "minimum period for a fire pulse group" refers to a shortest time period in which a fire pulse group containing a particular amount of data can be transmitted. The particular amount of data may be the amount of data to communicate firing information for an address to all primitives in an array. The shortest time period may be a transmission time that produces a bit error rate below a threshold.

The printer may include a power supply, and each fluidic actuator that fires may draw power from the power supply. The power supply may be able to fire a limited number of fluidic actuators substantially simultaneously, or peak power consumption may be improved by limiting how many fluidic actuators fire substantially simultaneously. The printer may limit how many fluidic actuators are fired substantially simultaneously by transmitting a predetermined number of fire pulse groups for each address and splitting the indications of which fluidic actuators to fire among the fire pulse groups. As used herein, references to splitting fluidic actuators among or including fluidic actuators in fire pulse groups refer to splitting or including indications to fire those fluidic actuators among or in the fire pulse groups. Other fire pulse groups may still include indications not to fire those fluidic actuators. To transmit the resulting additional fire pulse groups, the print speed may be reduced below the maximum speed achievable for a particular minimum fluidic period, but customers may prefer higher print speeds. Alternatively, or in addition, the maximum communication frequency may be increased, but increasing the maximum communication frequency may increase manufacturing cost or limit compatibility with existing systems. In some examples, print data may be depleted to fire fewer actuators than would otherwise be fired without reducing speed, but the quality of the print product may be reduced. Printer performance may be improved by reducing the number of fluidic actuators firing substantially simultaneously without reducing print speed performance, print quality, or redesigning communication hardware.

FIG. 1 is a block diagram of an example printer 100 to schedule firing of fluidic actuators. The printer 100 may include an actuator selection engine 110. As used herein, the term "engine" refers to hardware (e.g., a processor, such as an integrated circuit or other circuitry) or a combination of software (e.g., programming such as machine- or processor-executable instructions, commands, or code such as firmware, a device driver, a script, object code, etc.) and hardware. Hardware includes a hardware element with no software elements such as an application specific integrated circuit (ASIC), a Field Programmable Gate Array (FPGA), etc. A combination of hardware and software includes software hosted at hardware (e.g., a software module that is stored at a processor-readable memory such as random access memory (RAM), a hard-disk or solid-state drive, resistive memory, or optical media such as a digital versatile disc (DVD), and/or executed or interpreted by a processor), or hardware and software hosted at hardware. The actuator selection engine 110 may determine, for an array including a plurality of fluidic actuators, which fluidic actuators to fire. For example, the actuator selection engine 110 may determine which fluidic actuators to fire to deliver printing fluid to particular locations on a print target.

The printer 100 may include a balancing engine 120. The balancing engine 120 may analyze the determined fluidic actuators to identify a large set of fluidic actuators scheduled to fire substantially simultaneously. As used herein, the term "large" refers to a number above a predetermined threshold, a number that when ranked relative to a similar class of numbers is above or at least a predetermined percentile, or a number that when ranked relative to a similar class of numbers is above or at least a predetermined rank. In an example, the actuator selection engine 110 may indicate the determined fluidic actuators to the balancing engine 120. The actuator selection engine 110 may indicate when the fluidic actuators are scheduled to fire, or the balancing engine 120 may determine when the fluidic actuators are scheduled to fire based on an identity of the fluidic actuator (e.g., an address of the fluidic actuator). Based on when the fluidic actuators are scheduled to fire, the balancing engine 120 may determine that a large set of fluidic actuators are scheduled to fire substantially simultaneously.

The balancing engine 120 may schedule the large set of fluidic actuators among a plurality of fire pulse groups. Each fire pulse group may include a subset of the large set of fluidic actuators to be fired at a time distinct from another subset of the large set of fluidic actuators. For example, the balancing engine 120 may include a first subset of the large set of fluidic actuators in a first fire pulse group for which fluidic actuators will be fired at a first time. The balancing engine 120 may include a second subset of the large set of fluidic actuators in a second fire pulse group for which fluidic actuators will be fired at a second time. Accordingly, the first and second subsets of fluidic actuators may be fired at different times, and the printer 100 avoids firing the large set of fluidic actuators substantially simultaneously. In some examples, the balancing engine 120 may include more than two subsets in more than two fire pulse groups.

Figure 2:
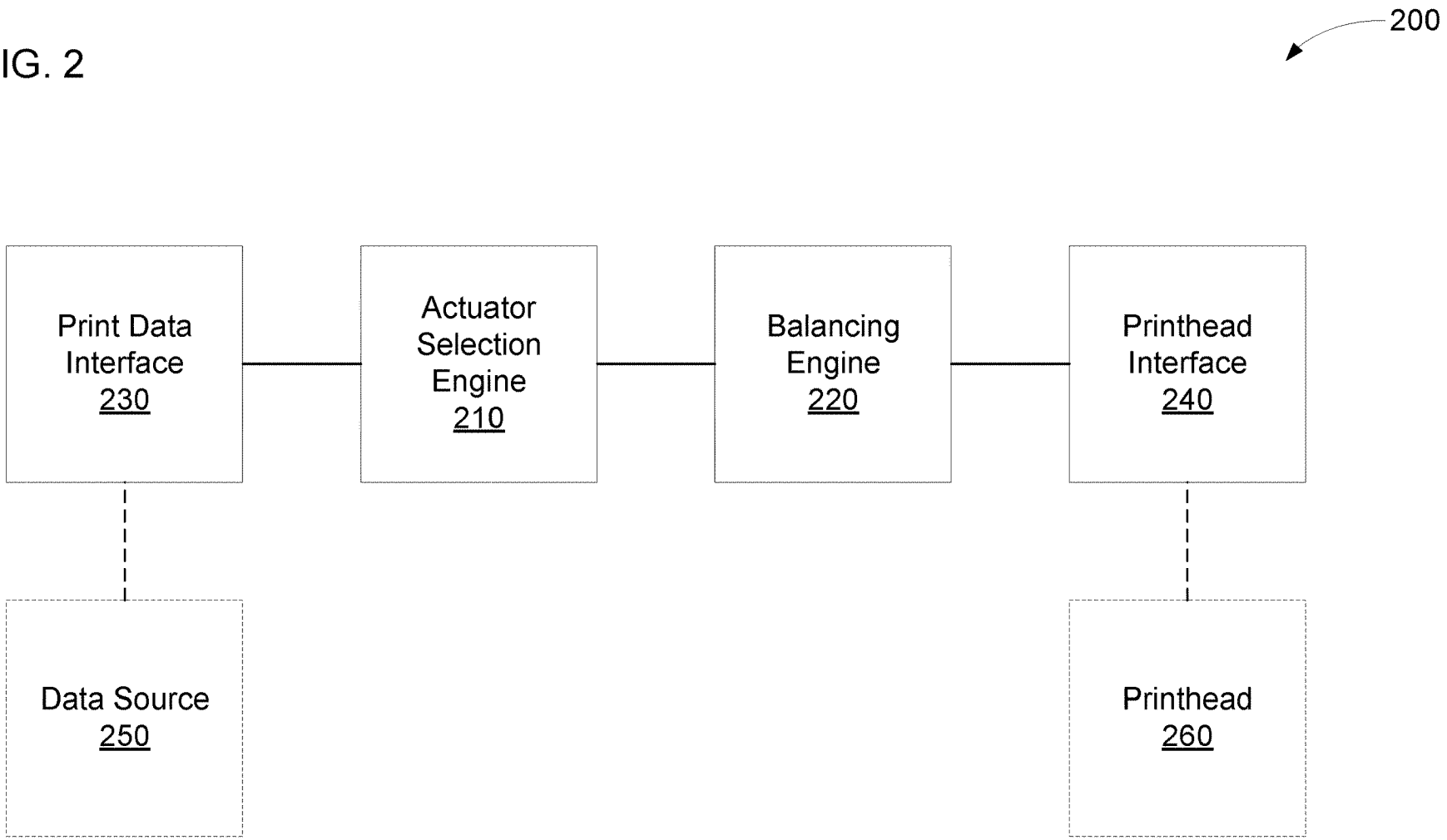
FIG. 2 is a block diagram of another example printer to schedule firing of fluidic actuators.

FIG. 2 is a block diagram of another example printer 200 to schedule firing of fluidic actuators. The printer 200 may include a print data interface 230. The print data interface 230 may be communicatively coupled to a data source 250, e.g., via a wired or wireless connection. The data source 250 may be distinct from or included in the printer 200. The print data interface 230 may receive or retrieve print data from the data source 250. The print data may include data indicative of content to be printed on a print target.

The printer 200 may include an actuator selection engine 210. The actuator selection engine 210 may process the print data. For example, the actuator selection engine 210 may convert the format of the print data. The actuator selection engine 210 may halftone the print data. For example, the actuator selection engine 210 may generate a halftone image based on the print data. The actuator selection engine 210 may determine, for an array including a plurality of fluidic actuators, which fluidic actuators to fire. For example, the actuator selection engine 210 may generate array data indicative of which fluidic actuators in each array should fire and when those fluidic actuators should fire to produce a representation of the halftone image on the print target.

The printer 200 may include a balancing engine 220. The balancing engine 220 may analyze the determined fluidic actuators to identify a large set of fluidic actuators scheduled to fire substantially simultaneously. For example, the actuator selection engine 210 may provide the array data to the balancing engine 220 or may store the array data in a location accessible to the balancing engine 220. Fluidic actuators in an array may be fired based on their addresses. For example, a fire pulse group may indicate for a particular address, which primitives should fire the fluidic actuator in that primitive associated with that address. The primitives may fire the fluidic actuators indicated by the fire pulse group substantially simultaneously. Accordingly, identifying the large set of fluidic actuators may include identifying how many primitives will fire fluidic actuators with a particular address substantially simultaneously. For example, the balancing engine 220 may determine how many primitives would be instructed to fire by a fire pulse group for a particular address. The balancing engine 220 may analyze a fire pulse group that has already been generated or data usable to generate the fire pulse group.

The balancing engine 220 may identify the large set of fluidic actuators to fire substantially simultaneously by identifying a set of fluidic actuators with more than a threshold number of fluidic actuators to fire substantially simultaneously. For example, the array data may include data for an array that includes a plurality of primitive groups. Each primitive group may include fluidic actuators with addresses unique among other fluidic actuators in the primitive group. In an example, no fluidic actuator in a primitive group may share an address with another fluidic actuator in the same primitive group. The addresses may be shared with fluidic actuators in other primitive groups. Identifying the set of fluidic actuators may include identifying an address with more than a threshold number of fluidic actuators to fire substantially simultaneously. Accordingly, the large set of fluidic actuators may include fluidic actuators with a shared address. In an example, a power supply may be limited to firing at most or fewer than fluidic actuators in 25%, 33%, 50%, 67%, 75%, etc. of the primitives in an array, so the threshold number may be that percentage of the number of primitives. The balancing engine 220 may determine whether a fire pulse group for a particular address would instruct more than or at least the threshold number of primitives to fire fluidic actuators substantially simultaneously.

The balancing engine 220 may identify the large set of fluidic actuators to fire substantially simultaneously by identifying a largest set of fluidic actuators scheduled to fire substantially simultaneously. Identifying the largest set of fluidic actuators may include identifying an address with a largest set of fluidic actuators scheduled to fire substantially simultaneously. The balancing engine 220 may compare the number of fluidic actuators that would be fired for each address in a print array group. The balancing engine 220 may determine the addresses for which the largest number of primitives would fire fluidic actuators substantially simultaneously. For example, the balancing engine 220 may select the top one, two, three, four, five, eight, ten, sixteen, etc. addresses with the largest number of primitives that would fire fluidic actuators substantially simultaneously.

The balancing engine 220 may schedule the large set of fluidic actuators to be fired among a plurality of fire pulse groups to fire subsets of the large set of fluidic actuators at a plurality of distinct times. For example, the balancing engine 220 may divide the large set of fluidic actuators into a plurality of subsets of fluidic actuators to be fired and include the subsets in different fire pulse groups. The subsets may be mutually exclusive so that not more than one subset includes any fluidic actuator or not more than one of the different fire pulse groups indicates that the fluidic actuator should fire. In some examples, all fluidic actuators in the large set of fluidic actuators to be fired are included in one of the subsets of fluidic actuators to be fired. The balancing engine 220 may generate the fire pulse groups indicating which fluidic actuators should be fired, which may include generating a plurality of fire pulse groups with the same address but each identifying different primitives to fire their fluidic actuators. The identified primitives may correspond to the subsets into which the large set of fluidic actuators have been divided. For sets of fluidic actuators (e.g., for addresses) determined by the balancing engine 220 not to be large, the balancing engine 220 may include indications of the fluidic actuators to be fired in a single fire pulse group.

In some examples, the printer 200 may have a minimum period for a fire pulse group that when multiplied by the number of addresses in the address space is less than a minimum fluidic period for the printer 200. For example, a print array group may include a plurality of fire pulse groups together including firing information for every fluidic actuator in the array. For example, each fire pulse group may include information for fewer than all of the fluidic actuators in the array, but in combination, the plurality of fire pulse groups may include firing information for every fluidic actuator. The print array group may include one fire pulse group for every address in the address space and may have a period at most or less than the minimum fluidic period. Accordingly, the balancing engine 220 may include multiple fire pulse groups in the print array group for an address. For example, the plurality of fire pulse groups with firing information for every fluidic actuator may include the plurality of fire pulse groups to fire the subsets of the large set of fluidic actuators, and the print array group may include more fire pulse groups than there are unique addresses for the array. The period for the print array group may still be at most or less than the minimum fluidic period for a fluidic actuator in the array even when including more fire pulse groups than there are unique addresses.

In some examples, the minimum fluidic period may not be an integer multiple of the minimum period for the fire pulse group multiplied by the number of addresses. For example, the minimum fluidic period for a fluidic actuator in the array may be less than twice, three times, four times, etc. the minimum period of a fire pulse group multiplied by the number of unique addresses in the array. The balancing engine 220 may dynamically determine for which addresses the print array group should include multiple fire pulse groups rather than, for example, including multiple fire pulse groups for predetermined addresses (e.g., every address). In some examples, the balancing engine 220 may include multiple fire pulse groups for predetermined addresses in a print array group.

The balancing engine 220 may dynamically determine how many fire pulse groups to include in the print array group, or the balancing engine 220 may include a predetermined number of fire pulse groups in the print array group. For example, the balancing engine 220 may dynamically determine how many fire pulse groups to include based on how many addresses include more than a threshold number of fluidic actuators to be fired. The balancing engine 220 may include a predetermined number of fire pulse groups in the print array group by including one fire pulse group for each address and an additional fire pulse group for the addresses with the largest numbers of fluidic actuators to be fired. The number of additional fire pulse group may be predetermined based on the difference between the predetermined number of fire pulse groups to be included in the print array group and the number of unique addresses. The balancing engine 220 may include multiple additional fire pulse groups for an address, for example, based on whether all addresses already have an additional fire pulse group, an address still includes a largest number of fluidic actuators even after its fluidic actuators have been split among multiple fire pulse groups, or the like.

In an example, the period of the print array group may exceed a minimum fluidic period if more than a particular number of additional fire pulse groups are included in the print array group. For example, the balancing engine 220 may determine that more than the particular number of addresses include more than a threshold number of fluidic actuators scheduled to fire and should receive additional fire pulse groups. In some examples, the balancing engine 220 may decide to decrease a print speed based on how many addresses include large sets of fluidic actuators scheduled to fire substantially simultaneously. The balancing engine 220 may vary the print speed dynamically based on how many fire pulse groups will be included in each print array group, or the balancing engine 220 may determine a static print speed in before printing begins based on the print array group that will include the largest number of fire pulse groups. In an example, the balancing engine 220 may decide to decrease the print speed based on deciding to include more than a threshold number of additional fire pulse groups. The balancing engine 220 may decide the amount to decrease the print speed based on by how much the number of additional fire pulse groups exceeds the threshold number. The threshold number may be a number that causes the period of the print array group to exceed the minimum fluidic period or may be a larger or smaller number.

In some examples, the balancing engine 220 may determine how many fire pulse groups to include in the print array group based on how many addresses include large sets of fluidic actuators and a minimum period for fire pulse groups. The balancing engine 220 may include at most or less than a predetermined number of fire pulse groups in the print array group. The predetermined number may be a number at or above which the speed of the printer would be decreased to accommodate the extra fire pulse groups. To avoid reaching or exceeding the predetermined number, the balancing engine 220 may reduce how many fluidic actuators will be instructed to fire by a fire pulse group without including an additional fire pulse group for omitted fluidic actuators, or the balancing engine 220 may not split a large number of fluidic actuators into subsets despite the large number exceeding a threshold. For example, the balancing engine 220 may split some sets of actuators among multiple fire pulse groups (e.g., the largest sets of actuators) but reduce how many actuators are fired for other sets of actuators (e.g., smaller sets of actuators that still exceed a threshold). In some examples, the balancing engine 220 may increase a period of the fire pulse groups if not enough addresses are firing sufficient fluidic actuators to justify additional fire pulse groups for those addresses and the period of the print array group would be less than minimum fluidic period. Alternatively, or in addition, the balancing engine 220 may include blank fire pulse groups (e.g., a fire pulse group indicating no fluidic actuators should be fired) or a time with no fire pulse groups if the period of the print array group would be less than minimum fluidic period.

In some examples, naïvely scheduling the large set of fluidic actuators among a plurality of fire pulse groups to fire subsets of the large set of fluidic actuators may result in violations of the minimum fluidic period for some of the fluidic actuators. For example, fluidic actuators with an address may be split among a plurality of fire pulse groups in a first print array group but may not be split in a second print array group immediately following the first. If the period of the first print array group equals the minimum fluidic period, a later fire pulse group in the first print array group may be closer to the fire pulse group for the same address in the second print array group than permitted by the minimum fluidic period. The balancing engine 220 may avoid scheduling fluidic actuators in a manner that produces violations of the minimum fluidic period. In some examples, a period of the print array groups may be set to be slightly greater than a minimum fluidic period for a fluidic actuator in the array to provide the balancing engine 220 with additional flexibility to avoid violations. As used herein, the term "slightly" refers to a value being no more than a predetermined percentage larger or smaller (e.g., 1%, 5%, 10%, 25%, 50%, etc.) and the predetermined percentage being no more than 50%. For example, the period of the print array groups may be one, two, three, four, etc. fire pulse group periods longer than the minimum fluidic period. In some examples, the balancing engine 220 may decide to decrease the printer speed to avoid a violation of the minimum fluidic period that would otherwise occur.

The balancing engine 220 may determine how to split fluidic actuators to be fired for an address among fire pulse groups or may determine how to arrange fire pulse groups in a print array group to avoid violations of the minimum fluidic period. The balancing engine 220 may analyze array data for a next print array group or predict array data for the next print array group to identify potential violations of the minimum fluidic period, and the balancing engine 220 may select which fluidic actuators to include in each of the plurality of fire pulse groups based on the analyzing or predicting. The balancing engine 220 may schedule fluidic actuators in earlier fire pulse groups or rearrange the fire pulse groups for different addresses to avoid violations of the minimum fluidic period that might occur with the next print array group. The balancing engine 220 may also, or instead, determine which fluidic actuators to include based on which fluidic actuators were fired by a previous print array group. For example, the balancing engine 220 may select which of the large set of fluidic actuators are included in each of the plurality of fire pulse groups based on the minimum fluidic period for a fluidic actuator in the array and a time since each fluidic actuator of the large set of fluidic actuators was fired. The balancing engine 220 may schedule fluidic actuators in later fire pulse groups or rearrange the fire pulse groups for different addresses to avoid violations of the minimum fluidic period that might occur due to the fluidic actuators fired by the previous print array group.

The balancing engine 220 may decide whether or not to split a set of fluidic actuators into multiple fire pulse groups based on whether there would be violations of the minimum fluidic period. For example, the balancing engine 220 may split a set of fluidic actuators at an address in a current print array group into multiple fire pulse groups to avoid a violation of the minimum fluidic period due to splitting of a set of fluidic actuators with the same address in the previous print array group. The balancing engine 220 may split the set of fluidic actuators despite not determining the set of fluidic actuators in the current print array group is large. The balancing engine 220 may include fluidic actuators that would violate the minimum fluidic period in a later fire pulse group and all remaining fluidic actuators in an earlier fire pulse group.

The balancing engine 220 may not split a set of fluidic actuators when doing so would create a violation of the minimum fluidic period in the next print array group (e.g., a violation that cannot be avoided in other ways). In an example, the balancing engine 220 may include two thresholds for determining large sets of fluidic actuators. A first threshold may indicate sets of fluidic actuators that can be split when doing so does not create violations of the minimum fluidic period, and a second threshold may indicate sets that should be split regardless of whether violations of the minimum fluidic period are created. Alternatively, or in addition, the balancing engine 220 may permit large sets of fluidic actuators in excess of a threshold to be included in a single fire pulse group to avoid a violation of the minimum fluidic period.

The balancing engine 220 may schedule the fluidic actuators based on the potential for cross talk among the fluidic actuators. For example, firing a fluidic actuator may cause a fluidic disturbance that can negatively affect firing of a neighboring or nearby fluidic actuator. The balancing engine 220 may select which fluidic actuators to include in each of the plurality of fire pulse groups to reduce cross talk with fluidic actuators with other addresses. For example, the fluidic actuators may be in a primitive with or otherwise near a fluidic actuator that fired in an immediately preceding fire pulse group, fired in an immediately succeeding fire pulse group, both, or neither. Accordingly, when scheduling among a plurality of fire pulse groups, the balancing engine 220 may schedule fluidic actuators with nearby preceding firings in a later fire pulse group, fluidic actuators with nearby succeeding firings in an earlier fire pulse group, fluidic actuators with both in a middle fire pulse group or in a fire pulse group that balances the distribution of fluidic actuators, or fluidic actuators with neither in a fire pulse group that balances the distribution of fluidic actuators. The balancing engine 220 may prioritize evenly distributing fluidic actuators among fire pulse groups and minimize cross talk to the extent possible. The balancing engine 220 may prioritize minimizing cross talk as long as the distribution of fluidic actuators satisfies a numeric or percentage threshold.

The printer 200 may include a printhead interface 240. The printhead interface 240 may mechanically or communicatively couple to a printhead 260 (e.g., to a cartridge comprising the printhead 260). The printhead 260 may be distinct from or included in the printer 200. The printhead interface 240 may communicate the print array group to the printhead 260, e.g., via a wired or wireless connection. The print array group may include a fire pulse group for every address in the address space and may include multiple fire pulse groups for a single address as previously discussed. The printhead 260 may fire fluidic actuators to eject a printing fluid based on the information contained in the print array group (e.g., the fire pulse groups) thereby producing a print product on a print target with the printing fluid.

Figure 3:
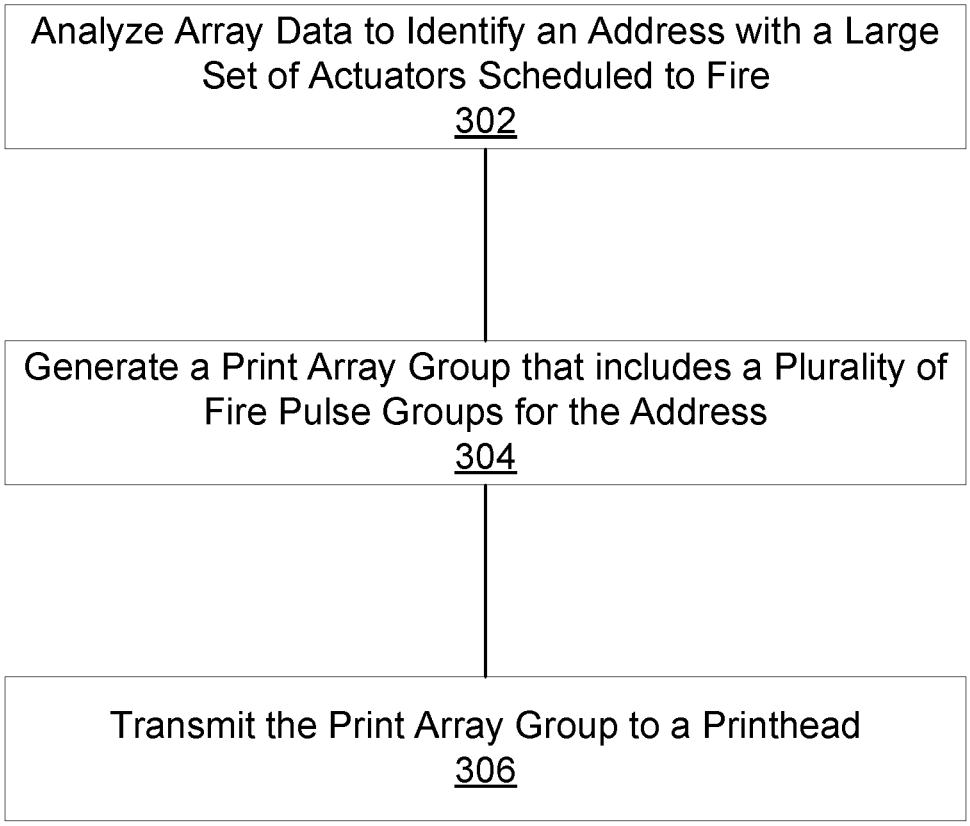
FIG. 3 is a flow diagram of an example method to schedule firing of fluidic actuators.

FIG. 3 is a flow diagram of an example method 300 to schedule firing of fluidic actuators. A processor may perform the method 300. At block 302, the method 300 may include analyzing array data to identify an address with a large set of fluidic actuators scheduled to fire substantially simultaneously. The array data may indicate a plurality of fluidic actuators from an array to fire. The plurality of fluidic actuators may include a plurality of addresses. For example, a printer may include arrays of fluidic actuators, and the array data may indicate or may be usable to determine when the fluidic actuators are going to fire. Accordingly, analyzing the array data may include determining based on the array data that a large set of fluidic actuators will be fired substantially simultaneously.

At block 304, the method 300 may include generating a print array group that includes a plurality of fire pulse groups for the address with the large set of fluidic actuators. Each of the plurality of fire pulse groups may include a subset of the large set of fluidic actuators. Each subset may be to be fired at a distinct time. For example, the large set of fluidic actuators may be divided up into the subsets of fluidic actuators and a fire pulse group may be generated for each subset. The fire pulse group may indicate to fire fluidic actuators in that subset but may not indicate or may indicate not to fire fluidic actuators in another subset.

At block 306, the method 300 may include transmitting the print array group to a printhead. The printhead may include the array that includes the plurality of fluidic actuators to fire. For example, transmitting the print array group may include applying a voltage or current to a conductor or semiconductor or emitting electromagnetic waves indicative of the information content of the print array group. Referring to FIG. 2, in an example, the balancing engine 220 may perform block 302, 304, or 306, or the printhead interface 240 may perform block 306.

Figure 4:
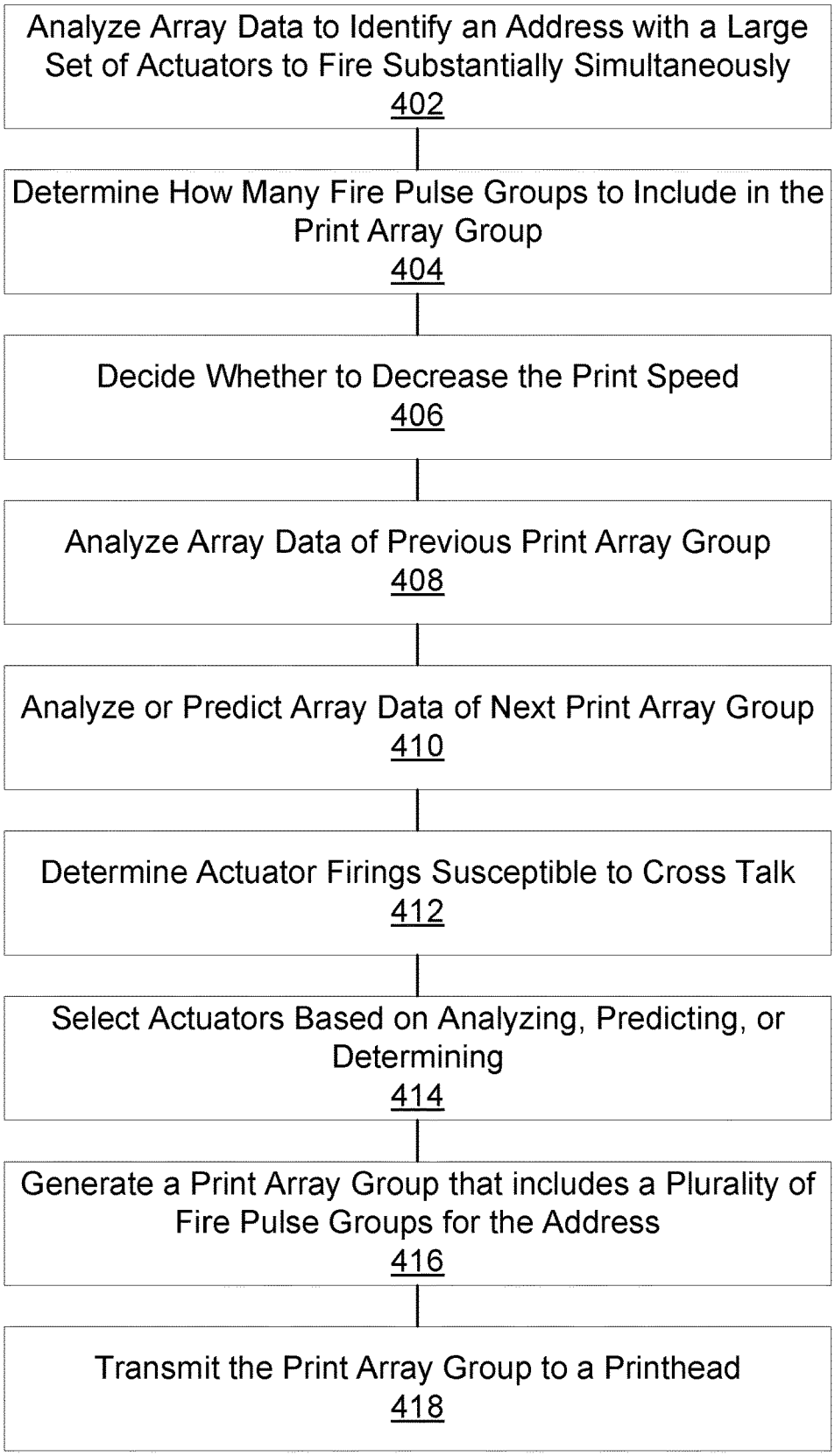
FIG. 4 is a flow diagram of another example method to schedule firing of fluidic actuators.

FIG. 4 is a flow diagram of another example method 400 to schedule firing of fluidic actuators. A processor may perform the method 400. At block 402, the method 400 may include analyzing array data to identify an address with a large set of fluidic actuators scheduled to fire substantially simultaneously. For example, fluidic actuators may be fired by address. Analyzing the array data may include determining for each address how many fluidic actuators are scheduled to be fired each time that address is to be fired. An address may be identified as having a large set of fluidic actuators scheduled to fire substantially simultaneously based on the number of fluidic actuators scheduled to fire exceeding a threshold, based on the address having one of the largest number of fluidic actuators scheduled to fire based on numeric or percentile rank, or the like.

Block 404 may include determining how many fire pulse groups to include in the print array group based on how many addresses include large sets of fluidic actuators and a minimum period for fire pulse groups. There may be a limit to how many fire pulse groups can be included in a print array group before the period of the print array group will be too large relative to the print speed. The number of fire pulse groups that can be included in the print array group may depend on the minimum period in which a fire pulse group can be transmitted. Determining how many fire pulse groups to include in the print array group may include determining how many to include based on the limit of how many fire pulse groups can be included before the period of the print array group is too large relative to the print speed. In some examples, the number of fire pulse groups may not exceed or reach the limit. If there are fewer or no more fire pulse groups than permitted by the limit, the number of fire pulse groups may be determined based on how many addresses include large sets of fluidic actuators without consideration of the minimum period for the fire pulse groups. The period of the fire pulse groups may be determined based on how many fire pulse groups are to be included in the print array group.

At block 406, the method 400 may include deciding whether to decrease the print speed based on how many addresses include large sets of fluidic actuators. For example, the print speed may be decreased based on the number of fire pulse groups in a print array group exceeding or reaching a limit. For example, the print speed may be set based on a minimum fluidic period or a period of the print array group (e.g., whichever is greater). Accordingly, the print speed may be decreased when a period of the print array group exceeds or reaches the period based on which the print speed was set. In some examples, the method 400 may include one of blocks 404 and 406 and not the other.

At block 408, the method 400 may include analyzing array data for a previous print array group. For example, the number or arrangement of fluidic actuators among fire pulse groups may create potential violations of the minimum fluidic period. Analyzing the array data may include detecting such potential violations based on the fluidic actuators fired in the previous print array group and the fluidic actuators to be fired in the current print array group.

Block 410 may include at least one of analyzing array data for a next print array group or predicting array data for the next print array group to identify potential violations of the minimum fluidic period. For example, the array data may be predicted based on previous print array groups or historic print jobs if the array data is unknown. The array data may be analyzed after prediction if unknown or analyzed without prediction if already known. Analyzing the array data may include detecting potential violations of the minimum fluidic period based on the fluidic actuators to be fired in the current print array group and the fluidic actuators known or predicted to be fired in the next print array group. In some examples, array data may be analyzed for multiple future print array groups. In some examples, the method 400 may include one of blocks 408 and 410 and not the other.

Block 412 may include determining fluidic actuator firings potentially susceptible to cross talk from fluidic actuator firings at other addresses. For example, determining the fluidic actuators potentially susceptible to cross talk may include determining fluidic actuators to be fired in fire pulse group that have nearby or neighboring fluidic actuators potentially firing in a previous or next fire pulse group or in both. Determining the fluidic actuator firings potentially susceptible to cross talk may include determining whether the potential cross talk will be with a previously fired fluidic actuator or a fluidic actuator to be fired next.

At block 414, the method 400 may include selecting which fluidic actuators to include in each of a plurality of fire pulse groups based on the analyzing, predicting, or determining of blocks 408, 410, or 412. For example, the fluidic actuators to be included in each fire pulse group may be selected based on analyzing the array data for previous print array group, based on analyzing or predicting the array data for a next print array group, or the like. The fluidic actuators to be included in each fire pulse group may be selected based on the determination of potential cross talk to reduce cross talk with other addresses. The avoidance of violations of the minimum fluidic period may be prioritized over avoiding cross talk, avoiding cross talk may be prioritized over violations of the minimum fluidic period, or the like. Avoiding violations of the minimum fluidic period may be prioritized over balancing the distribution of fluidic actuators among fire pulse groups or vice versa. Similarly, avoiding cross talk may be prioritized over balancing the distribution of fluidic actuators among fire pulse groups or vice versa. In some examples, the distribution of fluidic actuators among fire pulse groups may be unbalanced up to a numerical or percentage limit, which may be predetermined or determined based on the number of fluidic actuators to be fired.

Block 416 may include generating a print array group that includes the plurality of fire pulse groups for the address with the large set of fluidic actuators. Each of the plurality of fire pulse groups may include a subset of the large set of fluidic actuators, and each subset may be to be fired at a distinct time. In some examples, generating the print array group can include blocks 408, 410, 412, or 414. Generating the print array group may include generating fire pulse groups that each include indications to fire the fluidic actuators selected for that fire pulse group. Generating the print array group may include generating start bits, addresses, stop bits, or the like for each fire pulse group.

At block 418, the method 400 may include transmitting the print array group to a printhead. The print array group including the plurality of fire pulse groups may be transmitted to the printhead. The printhead may fire the fluidic actuators as indicated by the fire pulse groups. For example, the printhead may include a plurality of primitives which may read an address from each fire pulse group and determine whether to fire a fluidic actuator at that address based on whether the fire pulse group indicates to fire that fluidic actuator. The printhead may fire the indicated fluidic actuators to deliver a printing fluid to a print target to produce content indicated by the array data. In an example, the balancing engine 220 of FIG. 2 may perform blocks 402, 404, 406, 408, 410, 412, 414, 416, or 418, or the printhead interface 240 may perform block 418.

Figure 5:
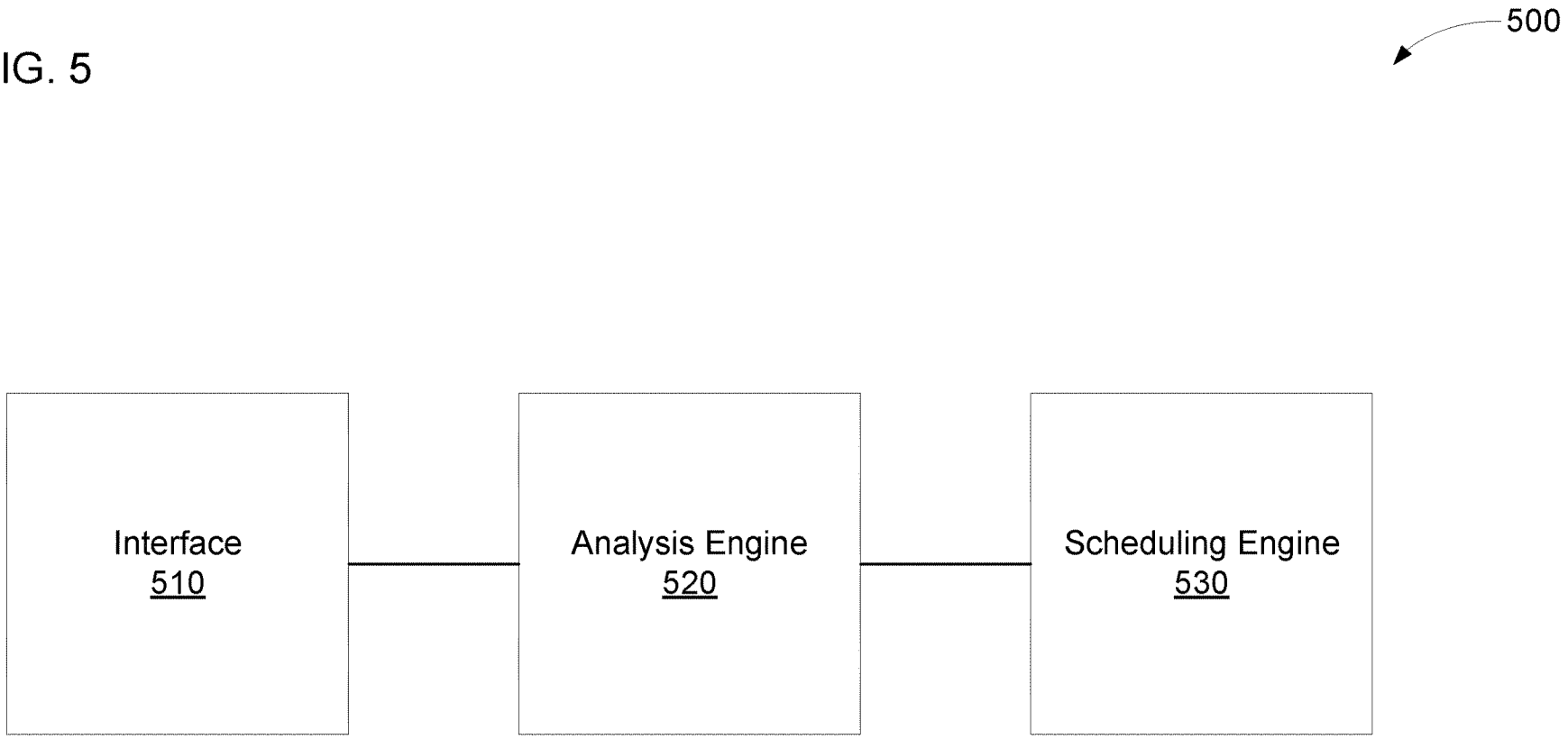
FIG. 5 is a block diagram of an example system to schedule firing of fluidic actuators.

FIG. 5 is a block diagram of an example system 500 to schedule firing of fluidic actuators. The system 500 may include an interface 510 to receive array data indicating a plurality of fluidic actuators from an array to fire. For example, the interface 510 may receive array data transmitted to it, or the interface 510 may retrieve the array data from a register, a memory, or the like. The interface may include wires or a wireless interface to receive the array data and may include an engine in some examples. The plurality of fluidic actuators may include a plurality of addresses. For example, each fluidic actuator may include an address. Multiple fluidic actuators may share an address.

The system 500 may include an analysis engine 520 to identify an address with a large set of fluidic actuators scheduled to fire substantially simultaneously. For example, the array data may indicate which fluidic actuators are to fire at which times, or the analysis engine 520 may determine which fluidic actuators are to fire at which times based on the array data. The analysis engine 520 may identify an address with a large set of fluidic actuators by identifying an address with a largest number of fluidic actuators scheduled to fire substantially simultaneously. For example, the analysis engine 520 may identify a predetermined number or percentage of addresses with the largest number of fluidic actuators. In some examples, the analysis engine 520 may identify an address with a large set of fluidic actuators by identifying an address with more or at least a threshold number of fluidic actuators scheduled to fire substantially simultaneously.

The system 500 may include a scheduling engine 530 to schedule firing of the large set of fluidic actuators among a plurality of fire pulse groups. Each fire pulse group may include a subset of fluidic actuators to be fired at a time distinct from another subset. The subsets may be mutually exclusive, and the scheduling engine 530 may include an indication to fire a particular fluidic actuator in at most one of the fire pulse groups. The scheduling engine 530 may select which fluidic actuators to include in each fire pulse group or subset. The scheduling engine 530 may select the fluidic actuators to include in each fire pulse group to avoid violations of a minimum fluidic period, to reduce cross talk, to balance the distribution of fluidic actuators, or the like. For example, the scheduling engine 530 may select which of the large set of fluidic actuators are included in each of the plurality of fire pulse groups based on a minimum fluidic period for a fluidic actuator in the array and a time since each fluidic actuator of the large set of fluidic actuators was fired. The scheduling engine 530 may avoid including a fluidic actuator in a fire pulse group that would result in the time since firing being less than or at most the minimum fluidic period.

A print array group may include a plurality of fire pulse groups that together including firing information for every fluidic actuator in the array. The plurality of fire pulse groups with firing information for every fluidic actuator may include the plurality of fire pulse groups to fire the subsets of the large set of fluidic actuators. Because the address with the large set of fluidic actuators may be divided among fire pulse groups, the print array group may include more fire pulse groups than there are unique addresses for the array. In some examples, a period of the print array group may be at most or less than a minimum fluidic period for a fluidic actuator in the array despite having more fire pulse groups than there are unique addresses. For example, the scheduling engine 530 may ensure that the period of the print array group is at most or less than the minimum fluidic period by limiting the number of fire pulse groups, or there may be few enough large sets of fluidic actuators that the period of the print array group is less than or at most the minimum fluidic period. In some examples, the scheduling engine 530 may decide to decrease a print speed if the period of the print array group exceeds the minimum fluidic period or another threshold. In an example, the minimum fluidic period may not be large enough to include a predetermined number of fire pulse groups per address. For example, the minimum fluidic period for a fluidic actuator in the array may be less than twice, three times, four times, etc. a minimum period of a fire pulse group multiplied by the number of unique address in the array. Accordingly, because the analysis engine 520 may dynamically determine which addresses should have multiple fire pulse groups, peak power consumption can be reduced by splitting large sets of fluidic actuators without having a predetermined number of fire pulse groups per address or reducing print speed.

Figure 6A:
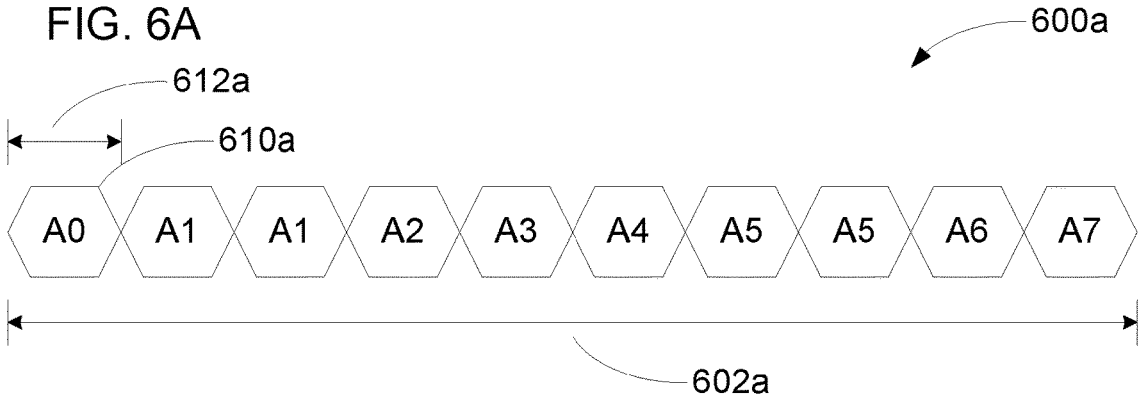
FIG. 6A is a schematic diagram of an example print array group.

FIG. 6A is a schematic diagram of an example print array group 600*a*. The print array group 600*a* may include a plurality of fire pulse groups 610*a*. Each fire pulse group 610*a* may have a period 612*a*. The fire pulse groups 610*a* include addresses A0 through A7. In the illustrated example, the fire pulse groups 610*a* are in numerical order. In some examples, the fire pulse groups 610*a* may not be in numerical order, or numerically adjacent addresses may not be physically adjacent. The print array group 600*a* may include a plurality of fire pulse groups 610*a* for the addresses A1 and A5 and single fire pulse groups 610*a* for the remaining addresses. The print array group 600*a* may have a period 602*a*. The print array group period 602*a* may equal the minimum fluidic period despite the extra fire pulse groups for addresses A1 and A5.

Figure 6B:
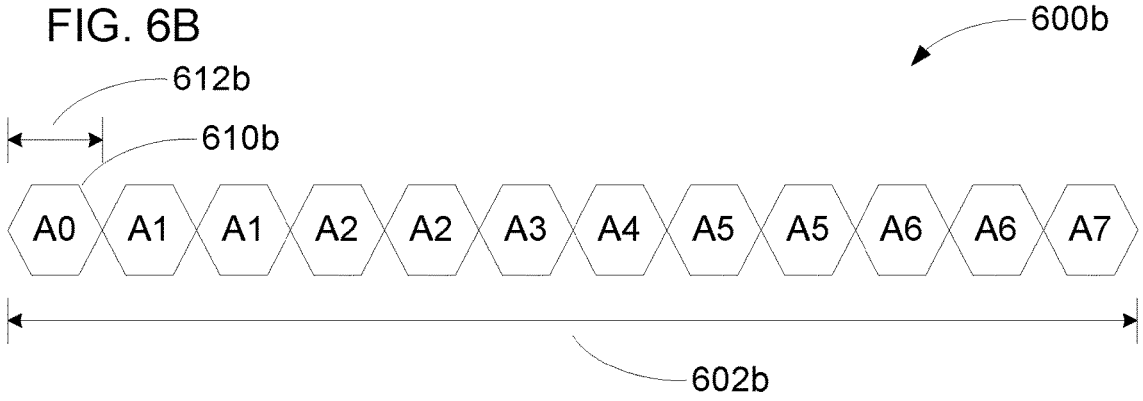
FIG. 6B is a schematic diagram of another example print array group.

FIG. 6B is a schematic diagram of another example print array group 600*b*. The print array group 600*b* may include a plurality of fire pulse groups 610*b*, which may each have a period 612*b*. The print array group 600*b* may include a plurality of fire pulse groups 610*b* for the addresses A1, A2, A5, and A6 and single fire pulse groups 610*b* for the remaining addresses. The print array group 600*b* may have a period 602*b*, which may equal the minimum fluidic period despite the extra fire pulse groups. The fire pulse group period 612*b* may be smaller than the fire pulse group period 612*a* of the previous example but the print array group periods 602*a*, 602*b* may be equal. In some examples, the fire pulse group period 612*b* may be varied based on how many fire pulse groups are included in the print array group 600*b*. The fire pulse group period 612*b* may be a minimum period for the fire pulse group 610*b*. For example, the fire pulse group period 612*b* may not be reduced further if more fire pulse groups are added. Accordingly, adding any more fire pulse groups 610*b* may cause the print array group period 602*b* to exceed the minimum fluidic period.

Figure 6C:
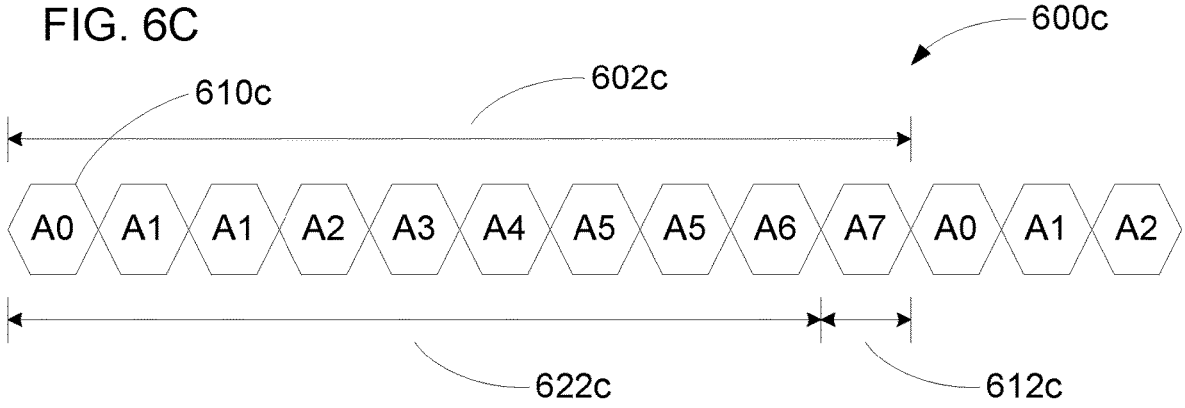
FIG. 6C is a schematic diagram of still another example print array group.

FIG. 6C is a schematic diagram of still another example print array group 600*c*. The print array group 600*c* may include a plurality of fire pulse groups 610*c*, which may each have a period 612*c*. The print array group 600*c* may include a plurality of fire pulse groups 610*c* for the addresses A1 and A5 and single fire pulse groups 610*c* for the remaining addresses. The print array group 600*c* may have a period 602*c*. The print array group period 602*c* may be slightly greater than a minimum fluidic period 622*c*. For example, the print array group period 602*c* may be longer than the minimum fluidic period 622*c* by one fire pulse group period 612*c*. The longer print array group period 602*c* may facilitate avoiding violations of the minimum fluidic period 622*c*. For example, the fluidic actuators with address A1 may be split among a plurality of fire pulse groups 610*c* in the print array group 600*c*. However, a single fire pulse group 610*c* may be used for the address A1 in the next print array group. Because the print array group period 602*c* is slightly greater than the minimum fluidic period 622*c*, the same fluidic actuators can be fired both in the second fire pulse group 610*c* for address A1 in the print array group 600*c* and in the single fire pulse group 610*c* for address A1 in the next print array group without violating the minimum fluidic period 622*c*.

The above description is illustrative of various principles and implementations of the present disclosure. Numerous variations and modifications to the examples described herein are envisioned. Accordingly, the scope of the present application should be determined only by the following claims.

What is claimed is:

1. A printer comprising:

an actuator selection engine to determine, for an array including a plurality of fluidic actuators, which fluidic actuators to fire; and a balancing engine to:

analyze the determined fluidic actuators to identify a large set of fluidic actuators scheduled to fire substantially simultaneously, and schedule the large set of fluidic actuators among a plurality of fire pulse groups, each fire pulse group including a subset of the large set of fluidic actuators to be fired at a time distinct from another subset.

2. The printer of claim 1, wherein the balancing engine is to identify the large set of fluidic actuators by identifying a set of fluidic actuators with more than a threshold number of fluidic actuators to fire substantially simultaneously.

3. The printer of claim 1, wherein the array includes a plurality of primitive groups, each primitive group including fluidic actuators with addresses unique among other fluidic actuators in the primitive group, the addresses shared with fluidic actuators in other primitive groups, and wherein the large set of fluidic actuators includes fluidic actuators with a shared address.

4. The printer of claim 1, wherein a print array group includes a plurality of fire pulse groups together including firing information for every fluidic actuator in the array, wherein the plurality of fire pulse groups with firing information for every fluidic actuator includes the plurality of fire pulse groups to fire the subsets of the large set of fluidic actuators, and wherein the balancing engine includes at most or less than a predetermined number of fire pulse groups in the print array group.

5. The printer of claim 1, wherein a print array group includes a plurality of fire pulse groups together including firing information for every fluidic actuator in the array, wherein the plurality of fire pulse groups with firing information for every fluidic actuator includes the plurality of fire pulse groups to fire the subsets of the large set of fluidic actuators, and wherein a period of the print array group is slightly greater than a minimum fluidic period for a fluidic actuator in the array.

6. A method, comprising:

analyzing array data to identify an address with a large set of fluidic actuators scheduled to fire substantially simultaneously, the array data indicating a plurality of fluidic actuators from an array to fire, the plurality of fluidic actuators including a plurality of addresses;

generating a print array group that includes a plurality of fire pulse groups for the address with the large set of fluidic actuators, each of the plurality of fire pulse groups including a subset of the large set of fluidic actuators, each subset to be fired at a distinct time; and transmitting the print array group to a printhead, the printhead comprising the array including the plurality of fluidic actuators.

7. The method of claim 6, further comprising determining how many fire pulse groups to include in the print array group based on how many addresses include large sets of fluidic actuators and a minimum period for fire pulse groups.

8. The method of claim 6, further comprising deciding to decrease a print speed based on how many addresses include large sets of fluidic actuators.

9. The method of claim 6, wherein generating the print array group that includes the plurality of fire pulse groups for the address includes:

at least one of analyzing array data for a next print array group or predicting array data for the next print array group to identify potential violations of a minimum fluidic period; and selecting which fluidic actuators to include in each of the plurality of fire pulse groups based on the analyzing or predicting.

10. The method of claim 6, wherein generating the print array group that includes the plurality of fire pulse groups for the address includes selecting which fluidic actuators to include in each of the plurality of fire pulse groups to reduce cross talk with other addresses.

11. A system comprising:

an interface to receive array data indicating a plurality of fluidic actuators from an array to fire, the plurality of fluidic actuators including a plurality of addresses;

an analysis engine to analyze the array data to identify an address with a large set of fluidic actuators scheduled to fire substantially simultaneously; and a scheduling engine to schedule firing of the large set of fluidic actuators among a plurality of fire pulse groups, each fire pulse group including a subset of the large set of fluidic actuators to be fired at a time distinct from another subset.

12. The system of claim 11, wherein the analysis engine is to identify the address with the large set of fluidic actuators by identifying an address with a largest number of fluidic actuators scheduled to fire substantially simultaneously.

13. The system of claim 11, wherein a print array group includes a plurality of fire pulse groups together including firing information for every fluidic actuator in the array, wherein the plurality of fire pulse groups with firing information for every fluidic actuator includes the plurality of fire pulse groups to fire the subsets of the large set of fluidic actuators, wherein the print array group includes more fire pulse groups than there are unique addresses for the array, and wherein a period of the print array group is at most or less than a minimum fluidic period for a fluidic actuator in the array.

14. The system of claim 11, wherein a minimum fluidic period for a fluidic actuator in the array is less than twice a minimum period of a fire pulse group multiplied by the number of unique address in the array.

15. The system of claim 11, wherein the scheduling engine is to select which of the large set of fluidic actuators are included in each of the plurality of fire pulse groups based on a minimum fluidic period for a fluidic actuator in the array and a time since each fluidic actuator of the large set of fluidic actuators was fired.

* * * * *